US006557617B1

(12) United States Patent
Bagnoud et al.

(10) Patent No.: US 6,557,617 B1
(45) Date of Patent: May 6, 2003

(54) METHOD FOR PROCESS MONITORING DURING DIE CASTING OR THIXOFORMING OF METALS

(75) Inventors: Christophe Bagnoud, Veyras (CH); Miroslaw Plata, Vetroz (CH); Jurgen Wust, Erding (DE); Klaus Wahrisch, Pliening (DE)

(73) Assignee: Alcan Technology & Management Ltd., Neuhausen am Rheinfall (CH)

( * ) Notice: Subject to any disclaimer, the term of this patent is extended or adjusted under 35 U.S.C. 154(b) by 0 days.

(21) Appl. No.: 09/763,527

(22) PCT Filed: Aug. 16, 1999

(86) PCT No.: PCT/EP99/06002

§ 371 (c)(1),
(2), (4) Date: May 25, 2001

(87) PCT Pub. No.: WO00/12246

PCT Pub. Date: Mar. 9, 2000

(30) Foreign Application Priority Data

Aug. 27, 1998 (EP) ..... 98810846

(51) Int. Cl.[7] ..... B22D 46/00; B22D 18/04
(52) U.S. Cl. ..... 164/4.1; 164/455; 164/458
(58) Field of Search ..... 164/4.1, 455, 458, 164/155.6

(56) References Cited

U.S. PATENT DOCUMENTS

| | | | | |
|---|---|---|---|---|
| 4,493,362 A | | 1/1985 | Moore et al. | |
| 4,976,305 A | * | 12/1990 | Tanaka et al. | 164/458 |
| 5,407,000 A | * | 4/1995 | Mercer, II et al. | 164/457 |
| 5,758,707 A | * | 6/1998 | Jung et al. | 164/4.1 |
| 5,772,933 A | | 6/1998 | Werner Kotzab | |
| 6,148,899 A | * | 11/2000 | Cornie et al. | 164/65 |

FOREIGN PATENT DOCUMENTS

| | | |
|---|---|---|
| DE | 44 44 092 | 4/1996 |
| EP | 0 065 841 | 12/1982 |
| EP | 0 126 174 | 11/1994 |

* cited by examiner

*Primary Examiner*—M. Alexandra Elve
*Assistant Examiner*—L Tran
(74) *Attorney, Agent, or Firm*—Bachman & LaPointe, P.C.

(57) ABSTRACT

A method for process monitoring during die casting or vacuum thixoforming of metals in a mold, wherein the time lapse of temperature (T) is continuously measured on at least one point of the system and the temperature progression of the system is calculated in real time using a program. The time lapse of the heat flow (W) is calculated from the temperature progression of the system and the time lapse of the energy (U) of the system and the solidification heat portion ($U_E$) of the metal solidified in the mold are calculated from the heat flow. At a given time, the calculated values are used as monitoring parameters.

14 Claims, 3 Drawing Sheets

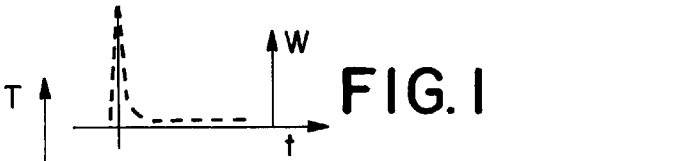
FIG. 1
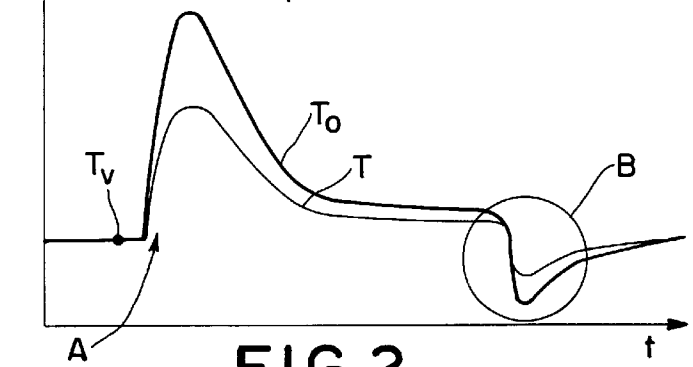
FIG. 2
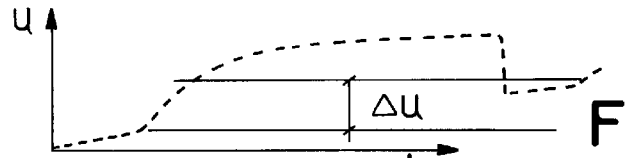
FIG. 3
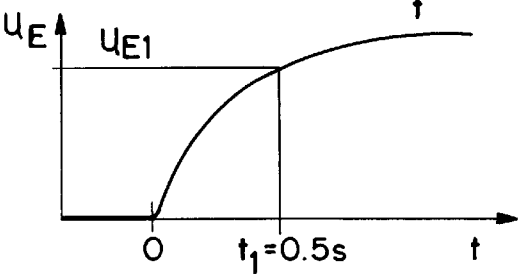
FIG. 4
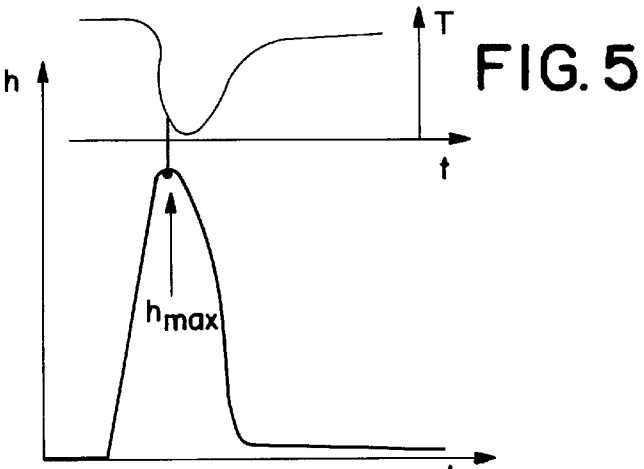
FIG. 5
FIG. 6
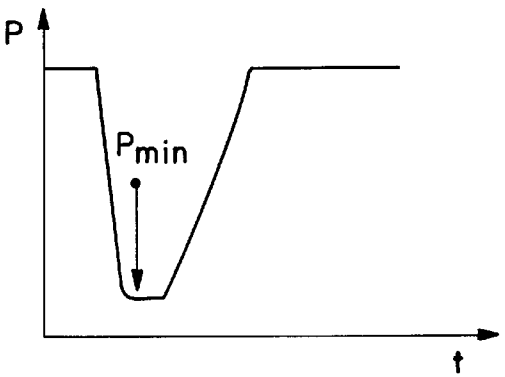
FIG. 7

METHOD FOR PROCESS MONITORING DURING DIE CASTING OR THIXOFORMING OF METALS

The invention relates to a method for process monitoring during die-casting or thixo-forming of metals in vacuum in a mould.

The automobile industry is placing ever increasing demands with respect to tolerances on the mechanical properties of diets and thixo-formed parts. As a means of achieving these high quality requirements, great importance is attached to the maximum possible monitoring of the process characteristics and their reproducibility. One essential factor, which directly determines the mechanical properties of a part manufactured by die-casting or thixo-forming, is the sequence in which the metal solidifies in the mould.

The object of the invention is to provide a process of the kind mentioned at the start by means of which the manufacture of die cast and thixo-formed parts can be monitored continuously and reliably under production conditions.

The object of the invention is achieved by way of the invention in that the change in temperature as a function of time is measured continuously at one place in the system and the change in temperature of the system is calculated in real time by means of a program and that, from the change in temperature of the system, the change in heat flow as a function of time and from the change in heat flow the change in the energy of the system and the magnitude of the heat of solidification of the metal in the mould is calculated, whereby the values calculated at a given time are used as characteristics for monitoring purposes.

The amount of heat exchanged between the metal to be cast and the mould halves determines the rate of solidification of the part manufactured by die-casting or thixo-forming. As the characteristics of this exchange directly contribute to determining the mechanical properties of the die-casting or thixo-formed part, it is essential that the solidification of the metal in the mould is monitored in order to achieve a high quality standard.

Determining the amount of heat conducted away by the mould makes it possible to detect whether the solidification occurs completely within the mould, whether pre-solidification occurs or what ratio of solid to liquid is present in a thixo-material.

A major fraction of the heat that is exchanged during solidification comes from the latent heat of fusion released during solidification. The magnitude of the latent heat depends in turn greatly on the fraction of liquid metal present on filling the mould. The amount of latent heat released via the mould halves depends in turn on the metal to be cast or on the alloy employed, and can be influenced by the temperature of the mould or mould halves, by the pressure applied, by the speed of the piston and by the thickness of the layer of lubricant.

The exchange of heat occurring during the different phases of solidification is calculated with the aid of a program The calculations are based on temperature measurements on the mould, whereby preference is given to measuring temperatures in the mould wall, and the change in temperature at the shape-giving surface of the mould is calculated. To that end, sensors are employed attached to the walls of the mould halves a distance of e.g. 1 mm from the surface. The program takes into account the inverse conduction of heat and calculates in real time the temperature at the shape-giving surface of the mould halves and the heat exchange between the solidifying metal and the mould. By means of temperature sensors arranged in this manner, it is possible to monitor in real time the uniformity of the cooling process and the thermal equilibrium at the surface of the mould during the successive phases of casting and cooling. The sensors are therefore preferably arranged where the thermal equilibrium and the solidification can be readily registered.

The index i.e. characteristic for the amount of heat conducted away at a given time lies preferably between approx. 20% and 100%, in particular between approx. 50% and 100% of the maximum heat of solidification In practice it has been found useful to calculate, as die-casing characteristic, the heat of solidification at a given time of 0.1 to 2 s, preferably 0.3 to 0.8 s and, in particular, approx. 0.5 s.

A further characteristic that may be employed is the temperature calculated for the mould surface immediately before each shot.

From the change in temperature it is possible to calculate the change in the heat exchange coefficient. The calculated value of heat exchange coefficient at a given time e.g. the maximum value in the solidification or cooling phase, or the overall plot in values may be employed as further characteristics.

From the change in the energy of the system it is also possible to employ—as an additional characteristic—the difference between the energy values at the start of filling the mould on successive shots.

From the change in temperature of the system it is possible to calculate the change in length of solidification as a function of time. By the length of solidification is to be understood the thickness of solidified metal measured from the mould surface. The length of solidification at a given time may be employed as a further characteristic.

Further possible characteristics are the minimum pressure, which is determined from the measurement of the change in pressure in the mould interior, and the minimum relative humidity measured in the mould interior immediately before a shot.

For the purposes of process monitoring the calculated or measured characteristics as actual values can be compared with the intended values, whereby provision may be made for an alarm signal being made when the actual values deviate too much from the intended values within a tolerance range and, when the tolerance range is exceeded, the die-casting or thixo-forming process is interrupted.

The intended value for the amount of heat of solidification removed is specified e.g. as an average value with a standard deviation. The standard deviation may e.g. be fixed as the first tolerance limit, which if exceeded by the actual value causes an alarm signal to be given.

Adhering to the intended values of the characteristics results in a uniformly high quality standard. Deviations from the intended values are registered in real time with the result that the appropriate corrective measures can be taken quickly.

A particularly interesting field of application for the described method is that of die-casting and thixo-forming, in particular as applied to aluminium and magnesium alloys, for example for manufacturing safety parts for the automotive industry.

BRIEF DESCRIPTION OF THE DRAWINGS

Further advantages, features and details of the invention are revealed in the following description of results from trials e.g. in die-casting and with the aid of the drawing which shows in FIG. 1 the change in heat flow as a function of time;

FIG. 2 the change in temperature during a die-casting cycle;

FIG. 3 the change in energy during a die-casting cycle;

FIG. 4 the change in the heat of solidification in region A in FIG. 2;

FIG. 5 the change in temperature during the cooling of the mould in region B in FIG. 2;

FIG. 6 the change in heat transfer coefficient during the cooling of the mould in region B in FIG. 2;

FIG. 7 the change in pressure in the mould cavity;

Shown in FIGS. 1 to 7 is the change in characteristics as a function of time which have been calculated by a program controlled computer on the basis of temperature and pressure measurements. The symbols in the Figures have the following meaning:

t=time $T_o$=calculated temperature at the shape-giving surface

Figure 8:
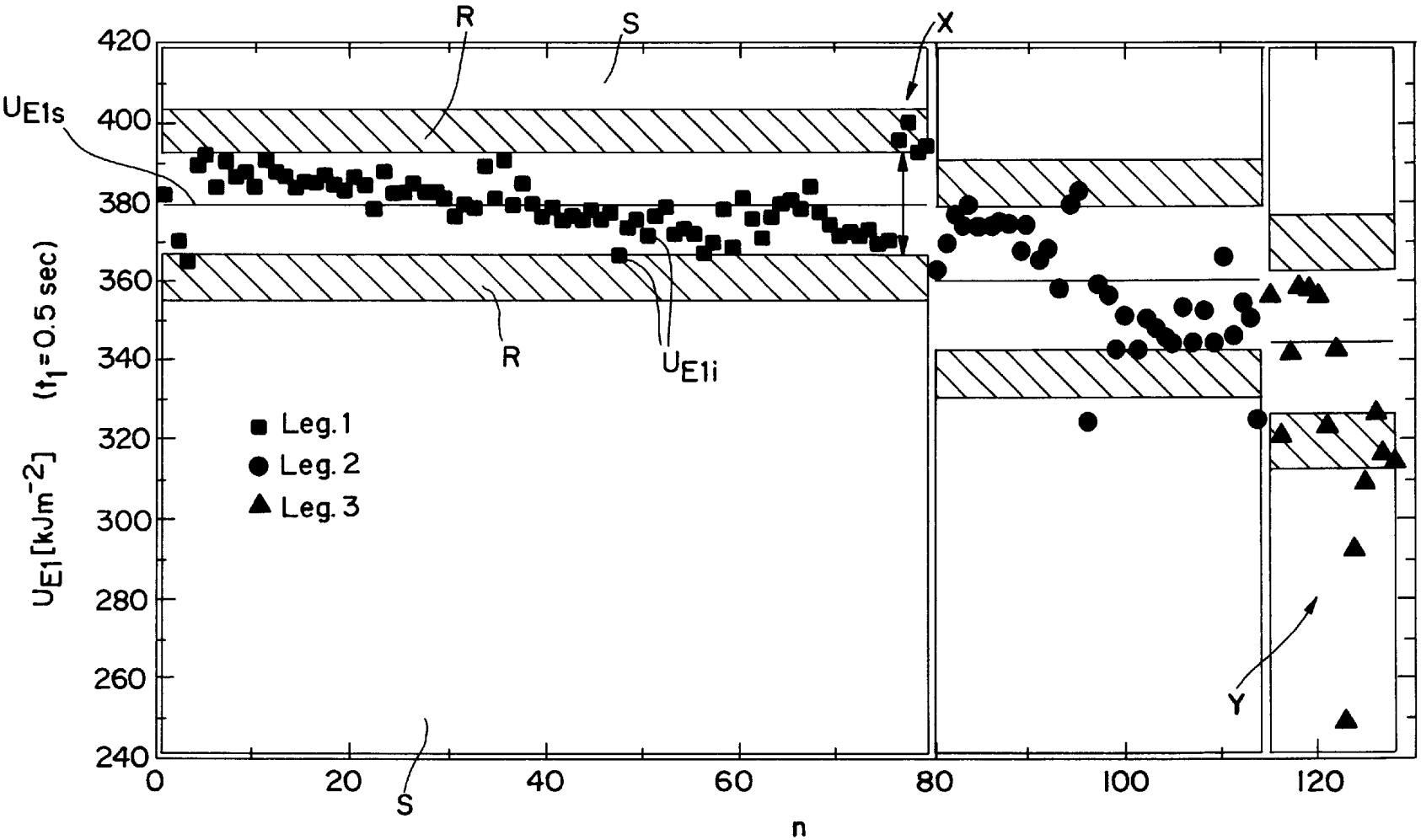
FIG. 8 the heat of solidification as an characteristic for three different aluminium alloys with increasing number of shots FIG. 9 a die-casting machine with process monitoring.

T=temperature measured in the mould wall 1 mm below the surface $T_v$=surface temperature of the mould immediately before the shot U=energy ΔU=energy difference between the start of filling the mould and after cooling it $U_E$=heat of solidification $U_{E1s,i}$=intended and actual values of the heat of solidification at time $t_1$=0.5 s W=heat flow h=heat exchange coefficient p=pressure in the mould cavity rH=relative humidity in the mould cavity n=number of shots FIG. 8 shows the results of a series of trials with three different aluminium alloys. 128 parts were cast on the same die-casting machine viz., 79 parts in alloy 1, 35 parts in alloy 2 and 14 parts in alloy 3. The plot shows the intended value of heat removed $U_{E1s}$ up to $t_1$=0.5 s as average value with standard deviation. The standard deviation defines a first limit value which along with a second limit value encloses a tolerance range R. The second limit value delimits the range R from the region of nonconformity S. If two successive actual values $U_{E1,i}$ for the heat of solidification lie in the tolerance range R, as is the case for the shots 76 to 79 (region X), then an alarm signal is given and the corresponding correction made. In the case of the shots in range X—these show too high a value for $U_{E1,i}$—the temperature $T_v$, of the surface of the mould immediately prior to the shot was about 30° C. lower than the average value of the previous shots. For shots 123 to 125 (region Y) the actual values $U_{E1,i}$ for the amount of heat of solidification that is conducted away lay in the region of non-conformity S. The reason for this was that the temperature of the melt was too low, which led to premature solidification outwith the mould and consequently to too low a value for the amount of heat of solidification that is conducted away. In this case an interruption in production is indicated and corrective measures carried out.

The results of the investigation shown in FIG. 8 show that a high quality level can be achieved using the process according to the invention for monitoring solidification. Deviations are indicated on-line. The calculated values can be transmitted e.g. via an RS232-interface to a programmable automatic unit that controls the die-casting machine. The data are checked , if desired displayed, and stored. If the calculated values for the heat of solidification lie in the tolerance range R, then an alarm signal can be given directly by the automatic control unit. If large deviations occur and values lie in the range S, then the production may be stopped e.g. automatically.

Temperature sensors may be installed at various places in the mould halves for the purpose of monitoring the process. The calculations are preferably performed individually for the individual temperature sensors and also registered individually as monitoring results. This way it is possible to localise specific production problems in the mould. The registered monitoring results are usefully archived and can be presented e.g. as evidence of the quality of a particular die-casing or thixo-formed part.

Figure 9:
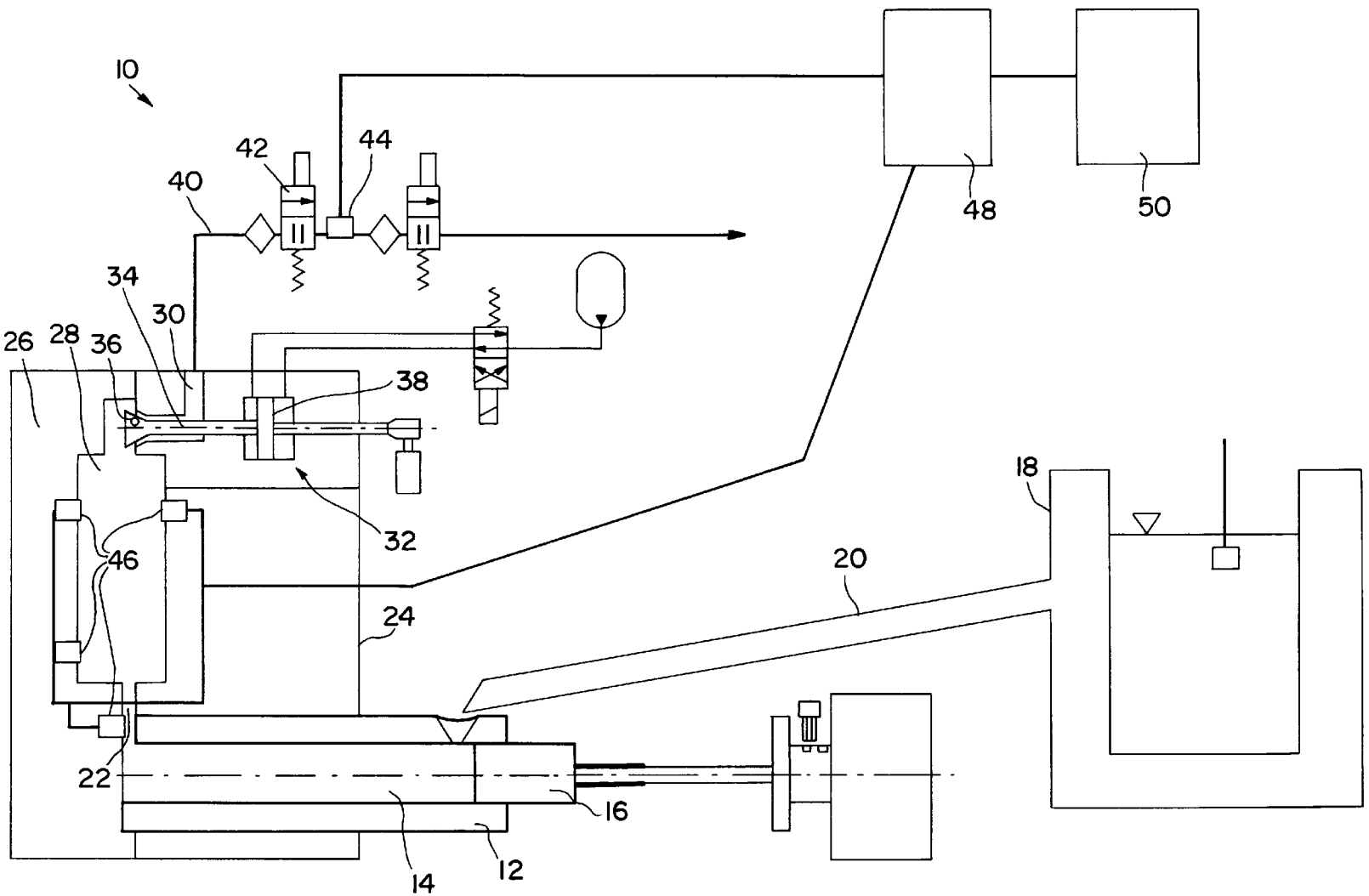

The monitoring of the process is made clear in the following description of FIG. 9.

A die-casting machine 10 features a filling chamber 12 with filling chamber cavity 14. The molten metal fed to the cavity 14 from a furnace 18 via feed pipe 20 for each shot is injected by a piston 16 from the cavity 14 via feed channel 22 into a mould cavity 28 formed by a stationary mould half 24 and a moveable mould half 26.

The mould cavity 28 features one or more venting channels 30 which if desired are brought together in the form of a combined channel. Situated in the stationary mould half 24 is a control unit 32 with a control rod 34. The control rod 34 features a closure head 36 for opening and closing the venting channel 30. Displacement of the control rod 34 is made by an actuating cylinder 38. When the fining of the mould has been carried out, the venting channel 30 is closed off at the end of the mould cavity 28 by means of the closure head 36 on the control rod 34.

Connected up to the control unit 32 is a vacuum pipeline 40 which is connected via valves 42 to a vacuum chamber which is not shown in the drawing. Before injection of the metal into the mould cavity 28, this is evacuated and the change in pressure in the mould cavity 28 measured via a pressure sensor 44 in the vacuum pipeline 40.

Temperature sensors 46 are incorporated at various places in both mould halves 24, 26. Not shown in the drawing is a sensor for measuring the relative humidity which is connected up to the mould cavity.

The temperature sensors 46, the pressure sensor 44 and the sensor for measuring the relative humidity not shown in the drawing are connected to a program-controlled computer 48. This computer transmits the measured and calculated characteristics to a data processor 50 for the purposes of archiving and monitoring. The release of an alarm signal or a stop in production on exceeding tolerance values for individual or all characteristics takes place directly via the computer.

What is claimed is:

1. A method for process monitoring during one of die casting and thixo-forming of metals in a mould under a vacuum, comprising:

continuously measuring the change in temperature (T) as a function of time in the mould wall proximate to a shape-giving surface of the mould;

calculating the change in temperature ($T_o$) at the shape-giving surface of the mould in real time from the measured change in temperature (T);

determining the change in heat flow (W) as a function of time from the calculated temperature ($T_o$); and calculating from the change in heat flow (W) both the change in energy (U) at the shape-giving surface of the mould and the magnitude of the heat of solidification ($U_E$) of the metal in the mould, wherein values ($T_o$, W, U, $U_E$) calculated at a given time are used as characteristics for monitoring purposes.

2. A method according to claim 1, wherein a characteristic for the heat of solidification ($U_{E1}$) that is dissipated at a given time ($t_1$) lies between 20% and 100% of the maximum heat of solidification ($U_{Emax}$).

3. A method according to claim 1, wherein a characteristic for the heat of solidification ($U_{E1}$) that is dissipated at a given time ($t_1$) lies between 50% and 100% of the maximum heat of solidification ($U_{Emax}$).

4. A method according to claim 2, wherein a characteristic calculated for die-casting is the heat of solidification ($U_{E1}$) at a given time ($t_1$) of 0.1 to 2 s.

5. A method according to claim 2, wherein a characteristic calculated for die-casting is the heat of solidification ($U_{E1}$) at a given time ($t_1$) of 0.3 to 0.8 s.

6. A method according to claim 2, wherein a characteristic calculated for die-casting is the heat of solidification ($U_{E1}$) at a given time ($t_1$) of about 0.5 s.

7. A method according to claim 1, wherein a temperature (Tv) calculated for the mould surface immediately before each shot is employed as a further characteristic.

8. A method according to claim 1, wherein change in heat exchange coefficient (h) is calculated from the change in temperature as a function of time and the heat exchange coefficient is employed as a further characteristic.

9. A method according to claim 1, wherein a difference ($\Delta U$) between the energy values at the start of filling the mould at successive shots is calculated from the change in energy as a function of time and is employed as a further characteristic.

10. A method according to claim 1, wherein a change in length solidified is calculated from the change in temperature (T) as a function of time and the calculated length solidified at a given time is employed as a further characteristic.

11. A method according to claim 1, wherein a change in pressure (p) in the mould is measured and the minimum pressure ($p_{min}$) is employed as a further characteristic.

12. A method according to claim 1, wherein a minimum relative humidity (rH) in the mould immediately before a shot is measured and employed as a further characteristic.

13. A method according to claim 1, wherein the calculated characteristics are taken as actual values and are compared with the corresponding intended values.

14. A method according to claim 13, wherein when the deviations of the actual values from the intended values are unacceptably large, the die-casting or thixo-forming process is interrupted.

* * * * *